United States Patent [19]

Pröpper et al.

[11] Patent Number: 4,703,607

[45] Date of Patent: Nov. 3, 1987

[54] STROKE-REDUCTION COVER EMPLACEMENT DEVICE

[75] Inventors: Wilhelm Pröpper, Langenfeld; Hans-Jürgen Knoll, Monheim, both of Fed. Rep. of Germany

[73] Assignee: Benz & Hilgers GmbH, Dusseldorf, Fed. Rep. of Germany

[21] Appl. No.: 856,418

[22] Filed: Apr. 22, 1986

[30] Foreign Application Priority Data

Apr. 17, 1985 [DE] Fed. Rep. of Germany ..... 3513754

[51] Int. Cl.[4] ..... B67B 3/22; B65B 7/28

[52] U.S. Cl. ..... 53/307; 74/833; 221/211

[58] Field of Search ..... 53/307, 306, 301, 302, 53/303; 74/600, 601, 833; 221/211, 262

[56] References Cited

U.S. PATENT DOCUMENTS

| | | | |
|---|---|---|---|
| 1,046,772 | 12/1912 | Gray | 74/833 |
| 1,109,462 | 9/1914 | Profitt | 74/833 X |
| 3,064,407 | 11/1962 | Logemann et al. | 53/307 |
| 3,293,823 | 12/1966 | Anderson | 53/307 X |
| 3,487,622 | 1/1970 | Mueller | 53/307 X |
| 3,509,682 | 5/1970 | Logemann | 53/307 X |
| 4,611,454 | 9/1986 | Proepper | 53/307 |
| 4,622,793 | 11/1986 | Oki | 74/833 X |

*Primary Examiner*—Horace M. Culver

*Attorney, Agent, or Firm*—Karl F. Ross; Herbert Dubno

[57] ABSTRACT

Gripper devices transfer covers from a magazine onto filled packing containers guided along a substantially horizontal transport trajectory. The gripper devices are on a supporting shaft which is driven via a rod system 18 by a grooved cam plate and a roller lever interacting therewith. By shortening the effective lever arm of the roller lever with the use of an adjusting unit coming into operation when the cover mounting device is blocked, the articulation point of the rod system in an elongated slot of the roller lever is altered in such a way that the stroke movement of the rod system and thus of the supporting shaft and of the suction elements or gripping devices becomes shorter, i.e. a short stroke occurs, thus ensuring that no further covers are extracted from the magazine and placed on the packing container.

9 Claims, 5 Drawing Figures

STROKE-REDUCTION COVER EMPLACEMENT DEVICE

FIELD OF THE INVENTION

Our present invention relates to cover emplacement in packaging machines, i.e. to an apparatus for placing covers removed from a cover magazine on filled packing containers, moving along a transport path, conveyor or track of a filling and closing machine, using gripper devices for the transfer of the covers. More particularly, the invention relates to an apparatus operating with stroke reduction for placing covers removed from a cover magazine in which a stack of covers is accommodated, onto filled packing containers, moving along transport track of a filling and closing machine, with gripper devices actuated by a supporting shaft which accommodates these latter and which can be raised, lowered and also pivoted by a grooved cam plate, by a pivotably mounted roller lever provided with a roller and by a rod system.

BACKGROUND OF THE INVENTION

A cover mounting device of the aforementioned type is described in German patent document (open application) DE-OS No. 30 37 455. In this device the roller interacting with the grooved cam plate, i.e. the cam-follower roller is mounted on the free end of the roller lever, on a joint of which is mounted an intermediate lever connected by its free end to the supporting shaft via the rod system.

In practice it has been found that if the cover mounting device is blocked, e.g. because a cover is jammed in the cover magazine, a jerk occurs in the driving mechanism, the follower roller being thus lifted out of the grooved cam trajectory while the device is blocked. As a consequence the cam trajectory must be left open at one end. Apart from an unnecessary construction expense, the open end of the cam groove can prevent the device from running.

OBJECTS OF THE INVENTION

The principal object of the invention is to provide a cover-transfer device for the purposes described which will ensure, at moderate construction cost, that if the cover mounting device is blocked no further covers can be extracted from the magazine.

Another object of the invention is to provide an improved cover mounting device which avoids drawbacks of the prior art.

SUMMARY OF THE INVENTION

We have found that the problem described above can be overcome using a cam-followed roller engaging a grooved cam of the grooved cam plate which is mounted on a roller lever between its joint and its free end; according to the invention the rod system hinged to the free end of the roller lever, when the cover mounting device is blocked, can be varied in effective length by an adjusting unit which then becomes operative, so that the roller lever will then have a shorter effective lever arm.

This means provided by the invention reduce the stroke of the gripping devices and of the rod system considerably, thanks to the shortening of the effective lever arm of the roller lever. This prevents the gripping devices from extracting any further covers from the magazine if the cover mounting device becomes blocked and until the fault has been remedied.

The construction according to the invention, serving to shorten the effective stroke, ensures that even if the filling and closing machine completes its pass there will be no jerk in the stroke movement; the cam trajectory remains closed, so that cost is reduced.

According to the invention a joint head engages an elongated slot of the roller lever. This provides an easy means of shortening the stroke when necessary, particularly if the adjustment unit consists of a pneumatic cylinder-piston assembly.

In order to minimize the space occupied by the rod system and the supporting shaft we prefer to use a roller lever which is bent at an angle in the region of the driving shaft of the grooved cam plate. Altogether the system is so arranged that the axis of the joint of the roller lever and also the median line of the elongated slot and the axis of the cylinder-piston unit are situated in one and the same plane.

According to the invention, therefore:

A cover-transfer device for use in a packaging machine to transfer covers from a magazine containing a stack of covers above the device to filled containers displaced on a transport path past the device and located therebelow, comprises:

at least one cover gripper;

a support for the gripper rotatable to swing the gripper from an upwardly facing position to a downwardly facing position and displaceable with an operating stroke between an upper position in which the gripper can receive a cover from the magazine into a lower position in which the gripper can apply a thus-received cover to a container on the path; and drive means operatively connected to the support for rotating and displacing same, the drive means comprising:

a rotatable cam, a lever fulcrummed at one end and having a cam-follower roller at an intermediate location along its length, the cam-follower roller engaging the cam, a rod linkage pivotally connecting an opposite end of the lever with the support, and adjustment means operatively connected to a pivot connecting the opposite end of the lever with the support for shifting the pivot toward the fulcrum of the lever to thereby reduce the stroke of the support to prevent takeup of a cover from the magazine upon a failure therein.

The cover-transfer device can have its pivot guided in a longitudinally extending slot formed in the other end of the lever.

The adjustment means can be a pneumatic piston-and-cylinder unit mounted on the lever.

The cam can be driven by a main shaft, the lever being offset between its ends in a region of the shaft.

The support can be a shaft provided with rollers at opposite ends thereof engaged in cam grooves of a pair of plates disposed at the ends of the shaft, each of the grooves having an upper linear stretch and a lower linear stretch on opposite sides of oppositely inclined ramp stretches, the rod linkage including a further lever articulated to the shaft by a tractive member, and a rod pivotally connected to the further lever.

The support is preferably provided with a guide slidable in a bore formed in a sleeve pivotable about a fixed axis located generally in the region of the ramps.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
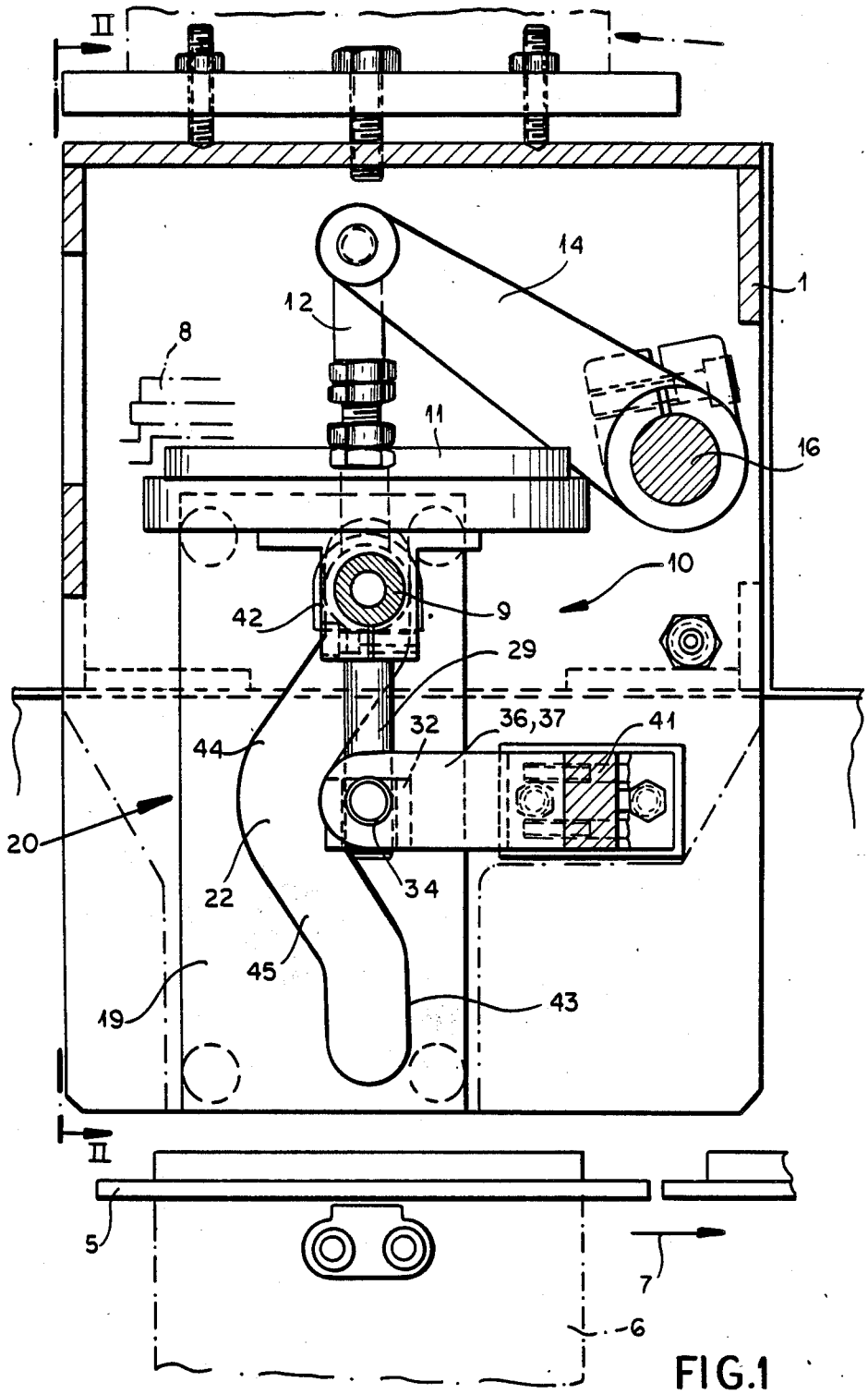
FIG. 1 is a section taken along the line I—I of FIG. 2.
Figure 2:
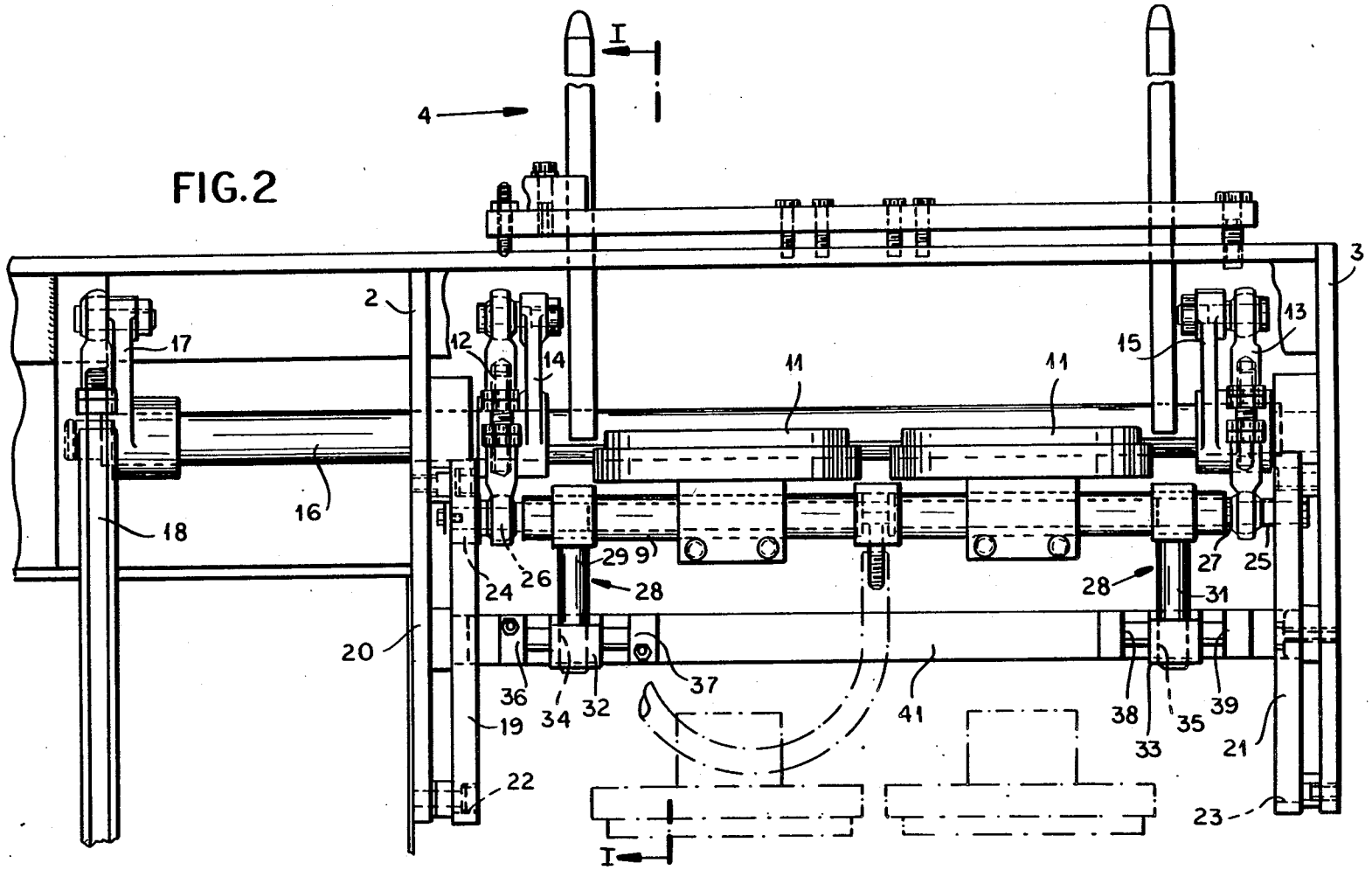
FIG. 2 is a section taken along the line II—II of FIG. 1.

FIGS. 1 through 2 show a device for mounting the cover which comprises a housing 1 with side walls 2 and 3 and a cover magazine 4 which is mainly situated above the said housing 1 shown only schematically.

Beneath the housing 1 is a conveyor 5 on which packing containers 6 are transported inside a filling and closing machine in a direction shown by the arrow 7. As may be seen from FIG. 2, two packing lines are provided next to one another.

The cover magazine 4 extending into the housing 1 contains covers 8 which are stacked one above the other and which can be extracted from the magazine 4 and placed on a respective packing container 6 which has previously been filled with a product.

For this purpose a transfer device 10 is provided inside the housing 1. The transfer device 10 is fitted with a supporting shaft 9 which is hollow to enable the supply of compressed air for operating the grippers 11 and which can be fitted with the gripping devices 11 which are clamped onto it when, as is preferred, the grippers 11 are suction elements, the suction can be applied through the shaft 9.

Figure 1A:
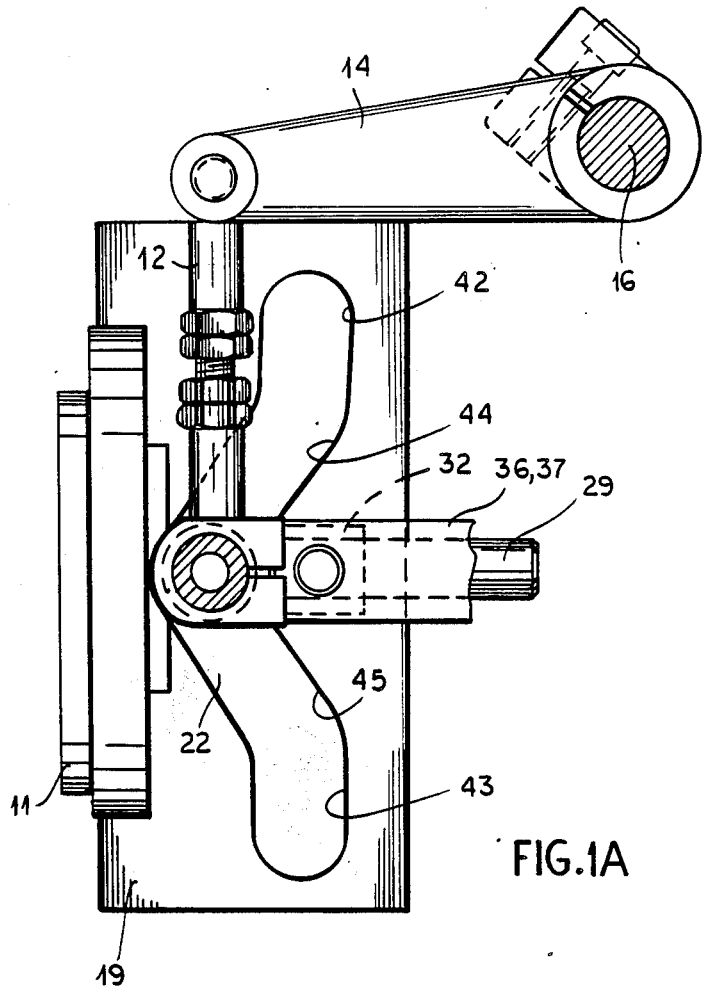
FIGS. 1A and 1B are fragmentary sections similar to FIG. 1 but showing the mechanism for transferring the covers in two other operative positions.
Figure 1B:
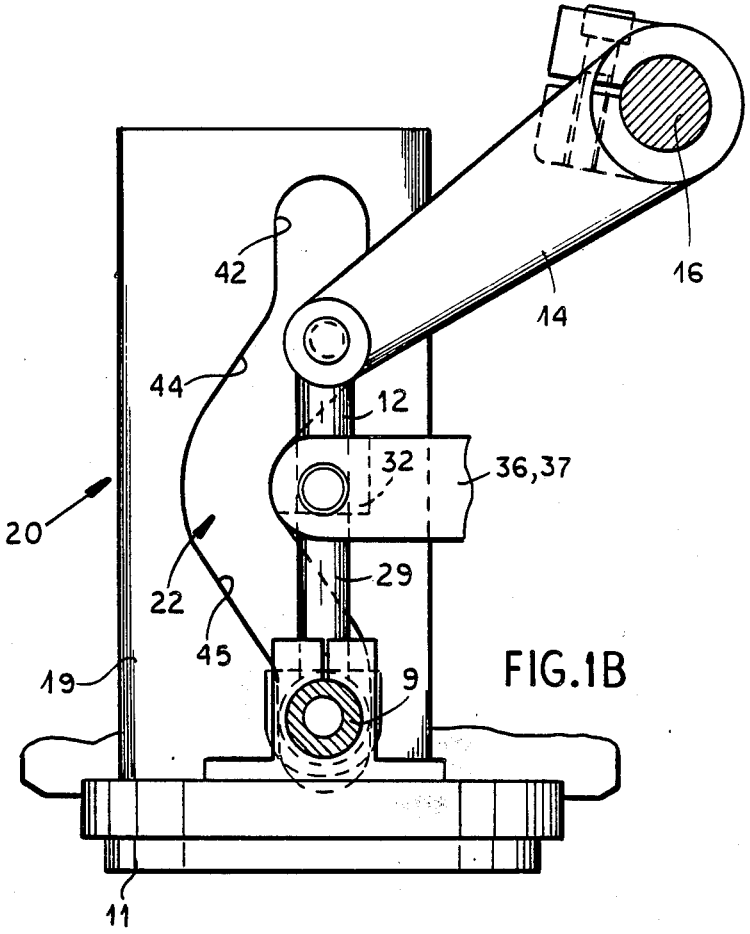

For the extraction of covers 8 from the cover magazine 4 and for the transfer of these covers 8 to the filled packing containers 6 the suction elements 11 are pivoted through an angle of 180° (compare FIG. 1 with FIG. 1B). This necessitates an appropriate automatic control of the supporting shaft 9.

The supporting shaft 9 is connected, via stay heads 12 and 13 accommodated in the housing 1 and also via levers 14 and 15 connected with the stay heads, to a driving shaft 16 which in turn is controlled and driven, via a lever 17 and a rod system 18, by a driving mechanism discussed in greater detail in connection with FIG. 3.

Parallel side walls 2 and 3 and the housing 1, and at a slight distance therefrom, are side plates 19 and 21 formed with respective curved guide slots 22 and 23 of a link guide 20 cam-follower rollers 24 and 25 engage the guide slots 22 and 23 and are mounted on supporting pins 26 and 27 which are screwed into the supporting shaft 9 and by which the stay heads 12 and 13 are at the same time connected to the said supporting shaft 9.

The link guide 20 formed by the guide slots 22 and 23 and the rollers 24 and 25 interacts with a cross head guide 28 formed by guide pins 29 and 31 affixed to the supporting shaft 9 and by guide pieces 32 and 33 interacting with the guide pins 29 and 31. The guide pieces 30 and 33 are provided with bores 34 and 35, respectively, which extend into the shanks of the guide pins 29 and 31 and are slidably guided therein. The guide pieces 32 and 33 are constructed as double pin bearings, i.e. are able to rotate freely about the pins on both sides. The guide pieces 32 and 33 are constructed as double pin bearings, i.e. are able to rotate freely about the pins on both sides. The guide pieces 32 and 33 are mounted in projecting straps and are secured as a whole by a traverse 41.

The guide slots 22 (the guide slot 23 is of identically similar construction), see FIG. 1, has a rectilinear approach 42 zone, a rectilinear terminal zone 43 and a rising zone 44 and falling zone 45 situated between them.

The guide slot 22 and the bearing pin of the guide piece 32 are so arranged that the axis of the pin of the guide piece 32 is located in the plane between the rising zone 44 and the falling zone 45 of the guide slot 32 and coincides with the middle of the approach zone 42 and of the terminal zone 43 of the guide slot 22. This special arrangement of the guide pieces and guide slots provides a particularly sensitive and easily adapted automatic control system for the supporting shaft 9.

Figure 3:
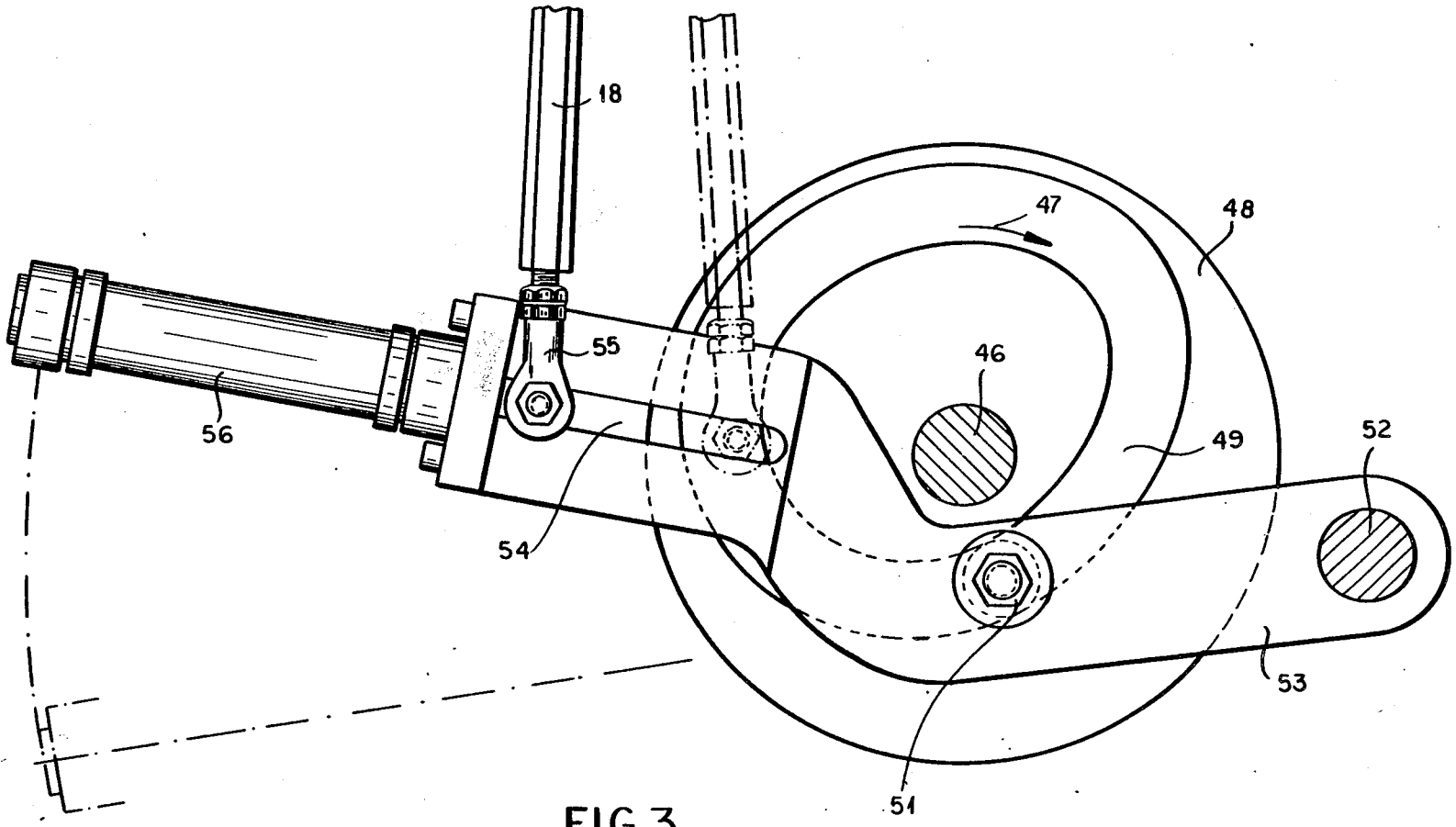
FIG. 3 is an elevational view of a driving mechanism for the device.

FIG. 3 shows in detail the driving mechanism for the rod system 18 and the gripping devices taking the form of the suction elements 11. The driving mechanism 10 has a main driving shaft 46 to which is affixed a grooved cam plate 48 rotating in the direction shown by the arrow 47.

A closed grooved cam (sleeve cam) 49 in the grooved cam plate 48 interacts with the roller 51 situated in the middle of a roller lever 53 mounted so as to be pivotable about a joint 52. The roller lever 53, which is bent in the region of the main driving shaft 46, is provided at its free end with an elongated slot 54 engaged by a joint head 55 of the rod system 18.

The joint head 55 can be shifted by means of an adjusting unit 56, taking the form of a pneumatic cylinder-piston assembly, for a preselectable period, e.g. if the cover mounting device becomes blocked, into the position shown by dot-dash lines, so that the joint head 55 will come to rest at the inner end of the elongated slot 54. Because of this reduction in the effective length of the system formed by the roller lever 53, the rod system 18, the lever 17 and the supporting shaft 16, the gripping device or devices in the form of the suction elements 11 likewise have a shorter stroke, so that while the device is thus blocked no covers can be extracted from the magazine.

In operation, as the grooved cam plate 48 makes a full revolution, the roller lever 53 interacting with it via the roller 51, the rod system 18 connected to the left hand side of the elongated slot 54 via the joint head 55 has a normal stroke during the normal operation of the device, so that the supporting shaft 9, starting from the position in FIG. 1, will be displaced, in accordance with the rhythm of the apparatus and of the filling and closing machine coupled thereto.

The displacement is initially downwards in a straight line in the approach zone 42 of the guide slots 22 and 23. In this process the guide bolts 29 and 31 are moved further into the bores 34 and 35 and the guide pieces 32 and 33.

On a further downward movement of the supporting shaft 9 the latter enters the rising zone 44 and the falling zone 45 of the guide system 22 and 23, with the result that the suction elements 11, via the combined movement of the link guide 20 and of the cross thread guide 28, are pivoted through 90° (FIG. 1A) and then through the remainder of an angle of 180° until finally, at the end of the movement, a guiding action is obtained in the terminal zone 43. so that starting from the withdrawal of covers from the magazine 4 a cover 8 can be placed on a filled packing container (FIG. 1B). Ascending movement of the supporting shaft 9 causes a reverse order of the aforementioned operations.

If the cover mounting device is blocked during operation owing to the tilting and jamming of the covers in the magazine 4, damage to the apparatus and further withdrawal of covers must be prevented. When the device becomes blocked the joint head 55 of the rod system 18 is shifted by the adjusting unit 56 from the normal stroke position shown on the left of FIG. 3 into the short stroke zone situated to the right of the elongated slot 54 preferably automatically by a sensor at the magazine so that as the grooved cam plate 48 continues on its way the roller lever 53 subjects the rod system 18 to a shortened stroke movement, with the result that the suction elements 11 no longer reach the bottom of the cover magazine 4 or the top of the packing containers 6 to be closed.

We claim:

1. A cover-transfer device for use in a packaging machine to transfer covers from a magazine containing a stack of covers above the device to filled containers displaced on a transport path past the device and located therebelow, said device comprising:

at least one cover gripper;

a support for said gripper rotatable to swing said gripper from an upwardly facing position to a downwardly facing position and displaceable with an operating stroke between an upper position in which said gripper can receive a cover from said magazine into a lower position in which said gripper can apply a thus-received cover to a container on said path; and drive means operatively connected to said support for rotating and displacing same, said drive means comprising:

a rotatable cam, a lever fulcrummed at one end and having a cam-follower roller at an intermediate location along its length, said cam-follower roller engaging said cam, a rod linkage pivotally connecting an opposite end of said lever with said support, and adjustment means operatively connected to a pivot connecting said opposite end of said lever with said support for shifting said pivot toward the fulcrum of said lever to thereby reduce the stroke of said support to prevent takeup of a cover from said magazine upon a failure therein.

2. The cover-transfer device defined in claim 1 wherein said pivot is guided in a longitudinally extending slot formed in said other end of said lever.

3. The cover-transfer device defined in claim 1 wherein said support is a shaft provided with rollers at opposite ends thereof engaged in cam grooves of a pair of plates disposed at said ends of said shaft, each of said grooves having an upper linear stretch and a lower linear stretch on opposite sides of oppositely inclined ramp stretches, said rod linkage including a further lever articulated to said shaft by a tractive member, and a rod pivotally connected to said further lever.

4. The cover-transfer device defined in claim 3 wherein said support is provided with a guide slidable in a bore formed in a sleeve pivotable about a fixed axis located generally in the region of said ramps.

5. The cover-transfer device defined in claim 4 wherein said cam is a slave cam formed on a disk.

6. The cover-transfer device defined in claim 5 wherein said tractive member is of adjustable length.

7. A cover-transfer device for use in a packaging machine to trasfer covers from a magazine containing a stack of covers above the device to filled containers displaced on a transport path past the device and located therebelow, said device comprising:

at least one cover gripper;

a support for said gripper rotatable to swing said gripper from an upwardly facing position to a downwardly facing position and displaceable with an operating stroke between an upper position in which said gripper can receive a cover from said magazine into a lower position in which said gripper can apply a thus-received cover to a container on said path; and drive means operatively connected to said support for rotating and displacing same, said drive means comprising:

a rotatable cam, a lever fulcrummed at one end and having a cam-follower roller at an intermediate location along its length, said cam-follower roller engaging said cam, a rod linkage pivotally connecting an opposite end of said lever with said support, and adjustment means operatively connected to a pivot connecting said opposite end of said lever with said support for shifting said pivot toward the fulcrum of said lever to thereby reduce the stroke of said support to prevent takeup of a cover from said magazine upon a failure therein, said pivot being guided in a longitudinally extending slot formed in said other end of said lever, and said adjustment means being a pneumatic piston-and-cylinder unit mounted on said lever.

8. The cover-transfer device defined in claim 7 wherein said cam is driven by a main shaft, said lever being offset between its said ends in a region of said shaft.

9. The cover-transfer device defined in claim 7 wherein said unit has an axis, said fulcrum has an axis and said slot has a centerline coplanar with said axes.

* * * * *